US008091419B2

(12) United States Patent
Vontell et al.

(10) Patent No.: US 8,091,419 B2
(45) Date of Patent: Jan. 10, 2012

(54) FLUID PRESSURE OPERATED FIXTURE

(75) Inventors: John H. Vontell, Manchester, CT (US); Ronald W. Brush, Ringwood, NJ (US)

(73) Assignee: United Technologies Corporation, Hartford, CT (US)

( * ) Notice: Subject to any disclaimer, the term of this patent is extended or adjusted under 35 U.S.C. 154(b) by 396 days.

(21) Appl. No.: 12/408,155

(22) Filed: Mar. 20, 2009

(65) Prior Publication Data

US 2010/0236332 A1 Sep. 23, 2010

(51) Int. Cl.
*G01M 9/00* (2006.01)

(52) U.S. Cl. ..... 73/147

(58) Field of Classification Search ..... None
See application file for complete search history.

(56) References Cited

U.S. PATENT DOCUMENTS 4,184,375 A * 1/1980 Gray ..... 73/706
4,346,860 A 8/1982 Tedstone
4,687,412 A 8/1987 Chamberlain
4,720,235 A 1/1988 Lachance et al.
4,726,234 A * 2/1988 Pemberton ..... 73/756
5,239,822 A 8/1993 Buchacher
5,240,376 A 8/1993 Velicki
5,384,959 A 1/1995 Velicki
5,692,881 A 12/1997 Leibfried
5,890,285 A 4/1999 Pruitt et al.
5,941,446 A 8/1999 Yasui
6,003,754 A 12/1999 Rhodes
6,003,756 A 12/1999 Rhodes
6,045,325 A 4/2000 Horvath et al.
6,177,203 B1 1/2001 Garcia
6,190,133 B1 2/2001 Ress, Jr. et al.
6,431,837 B1 8/2002 Velicki
6,467,168 B2 10/2002 Wallis
6,532,658 B2 3/2003 Schreiber
6,691,580 B1 * 2/2004 Bertelsen ..... 73/730
6,725,912 B1 * 4/2004 Moll et al. ..... 165/144
6,726,444 B2 4/2004 Zhao et al.
7,049,548 B1 5/2006 Sjogren et al.
7,086,648 B1 8/2006 Steinetz
7,093,820 B2 8/2006 Anderson et al.
7,128,536 B2 10/2006 Williams et al.
7,266,941 B2 9/2007 Eleftheriou et al.
7,370,467 B2 5/2008 Eleftheriou et al.
7,402,026 B2 7/2008 Girgis et al.
7,425,003 B2 9/2008 Anderson et al.
7,431,196 B2 10/2008 Eilert et al.
7,431,307 B2 10/2008 Anderson et al.
7,438,524 B2 10/2008 Lyders et al.

* cited by examiner

*Primary Examiner* — Lisa Caputo
*Assistant Examiner* — Jermaine Jenkins
(74) *Attorney, Agent, or Firm* — Carlson Gaskey & Olds, P.C.

(57) ABSTRACT

A fixture includes a housing assembly defined along an axis. A pressure bar assembly is mounted to the housing assembly for movement relative the axis. A bladder assembly is mounted at least partially within the housing assembly such that pressurization of the bladder assembly is operable to exert a force on a workpiece along the axis with the pressure bar assembly.

17 Claims, 8 Drawing Sheets

FLUID PRESSURE OPERATED FIXTURE

STATEMENT REGARDING FEDERALLY SPONSORED RESEARCH OR DEVELOPMENT

This disclosure was made with Government support under N00019-02-C-3003 awarded by The United States Air Force. The Government has certain rights in this disclosure.

BACKGROUND

The present disclosure relates to a fixture, and more particularly to a fluid pressure operated fixture.

The bonding of aerospace components is facilitated by fixtures which apply a pressure. The fixture is often required to maintain pressure during a thermal bond cycle while accommodating the restricted geometry typical of aerospace component assemblies.

Although effective, conventional mechanical clamp fixtures often require the frequent replacement of threaded interfaces and may require significant force application to achieve the desired pressure loadings. Furthermore, conventional mechanical clamp fixtures may require calibration before every bond cycle which is often operator dependent.

SUMMARY

A fixture according to an exemplary aspect of the present disclosure includes a housing assembly defined along an axis. A pressure bar assembly is mounted to the housing assembly for movement relative the axis. A bladder assembly is mounted at least partially within the housing assembly such that pressurization of the bladder assembly is operable to exert a force on a workpiece toward the axis with the pressure bar assembly.

A fixture according to an exemplary aspect of the present disclosure includes a first and second housing which define a first and second slot. A first and second pressure bar movably mounted relative the respective first and second slot, the first and second pressure bar movable relative the axis in response to pressurization of the first and second bladder.

A method of simultaneously bonding a multiple of fairing to respective multiple of struts in a gas turbine engine case according to an exemplary aspect of the present disclosure includes mounting a fixture assembly to each of the multiple of fairing which extend at least partially around a respective strut. Pressurizing a bladder assembly within each of the fixture assemblies to exert a force to the respective fairing.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1A:
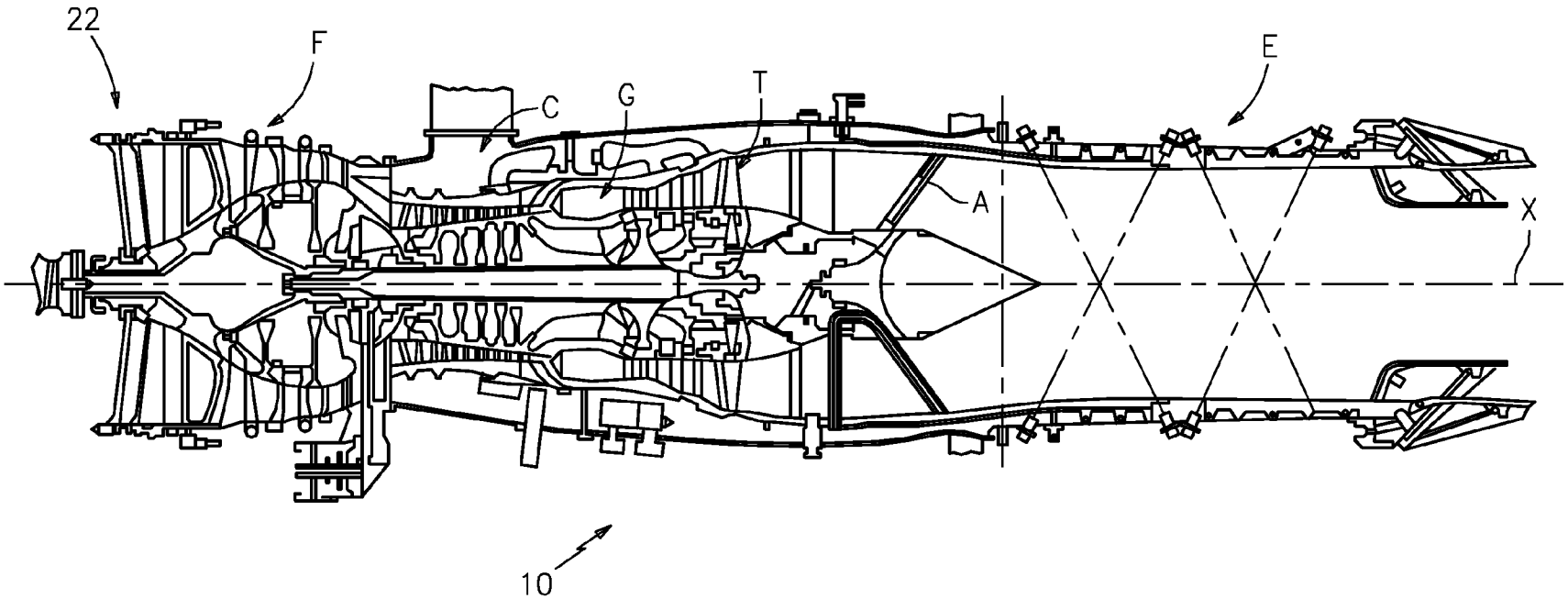
FIG. 1A is a schematic illustration of a gas turbine engine.

FIG. 1A schematically illustrates a gas turbine engine 10 which generally includes a fan section F, a compressor section C, a combustor section G, a turbine section T, an augmentor section A, and an exhaust duct assembly E. An engine longitudinal axis X is centrally disposed and extends longitudinally through these sections. While a particular type of gas turbine engine is illustrated, it should be understood that the claim scope extends to other types of gas turbine engines such as a high bypass ratio engines and gas turbine engines for power generation.

Figure 1B:
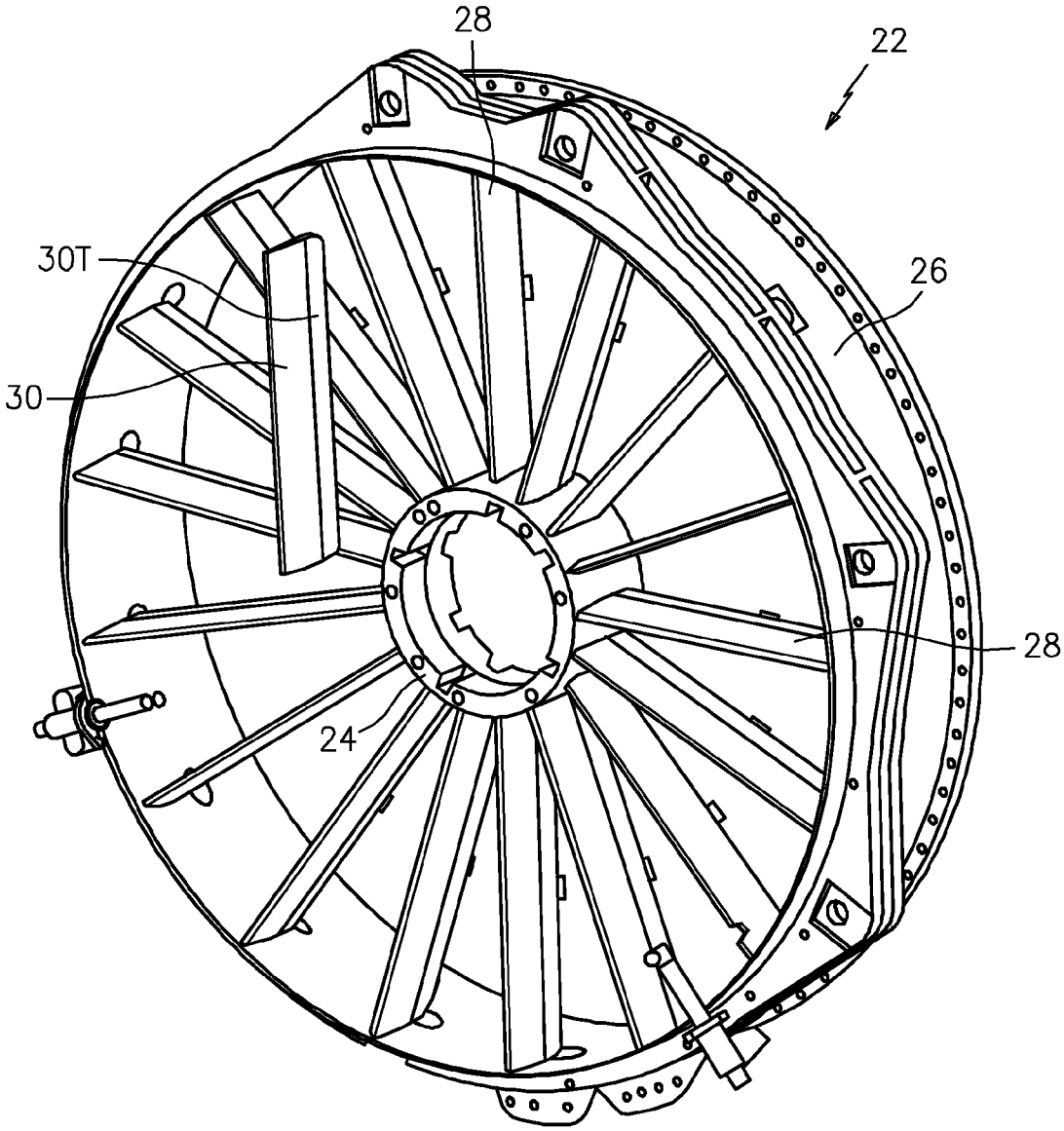
FIG. 1B is a perspective partial exploded view of an electro thermal fan inlet case of the gas turbine engine with a fan inlet shroud fairing (FISF) bondable to each strut by a fixture.

Referring to FIG. 1B, forward of the fan section F is an electro thermal fan inlet case 22. The electro thermal fan inlet case 22 includes an inner ring structure 24 and an outer ring structure 26 with a multiple of struts 28 therebetween. The electro thermal fan inlet case 22 is a unitary component with a fan inlet shroud fairing (FISF) 30 bonded to each strut 28. The FISF 30 is bonded to each strut 28 generally along a FISF trailing edge 30T thereof.

Figure 2A:
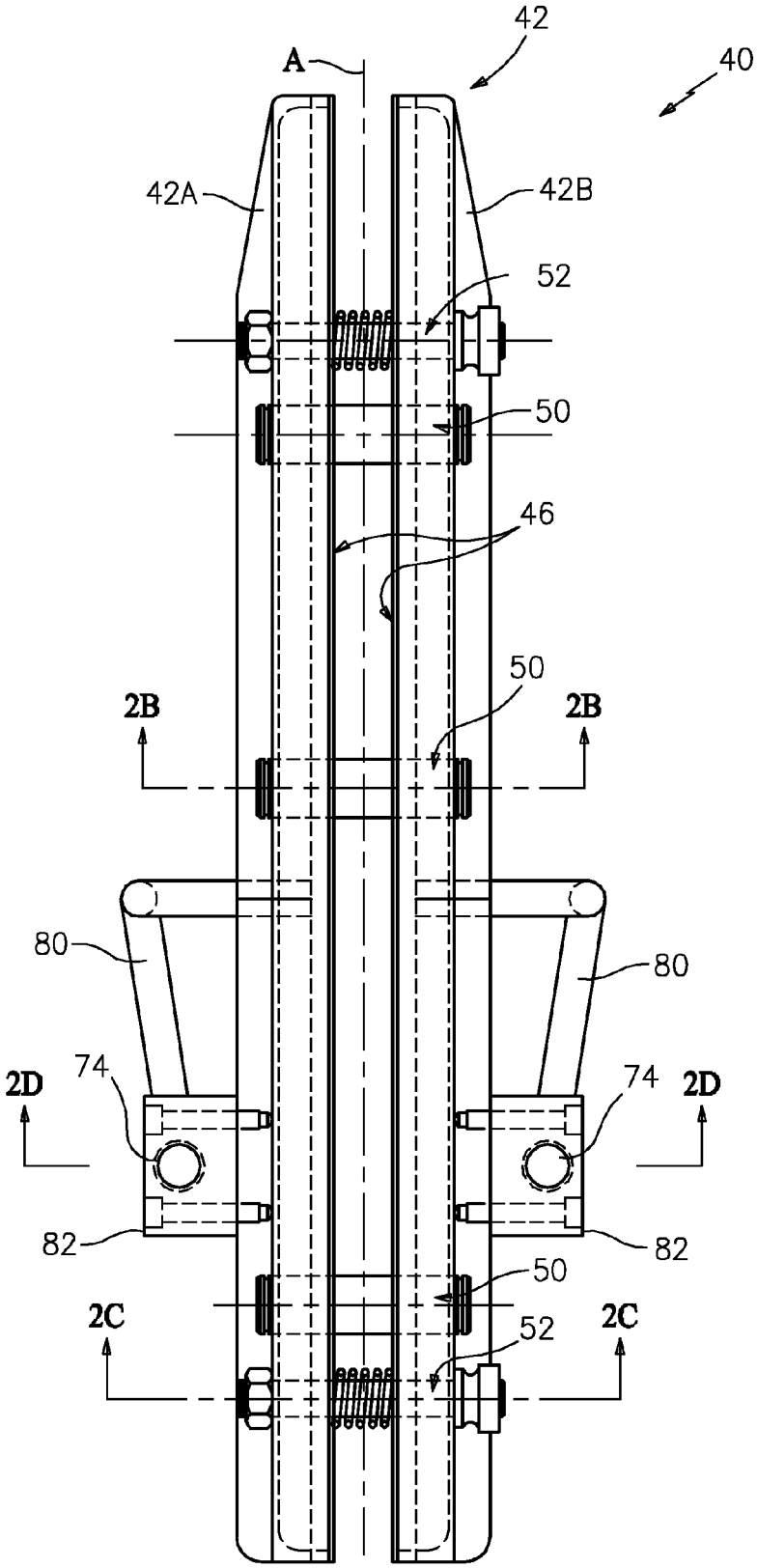
FIG. 2A is a top view of a fixture according to the exemplary aspect of the present disclosure.

Referring to FIG. 2A, a fixture 40 facilitates bonding of the FISF 30 to each strut 28. Although the fixture 40 is described herein with reference to the FISF 30, it should be understood that an appropriated sized fixture may be utilized to facilitate bonding of various componentry generally in accords to that disclosed herein.

Figure 3A:
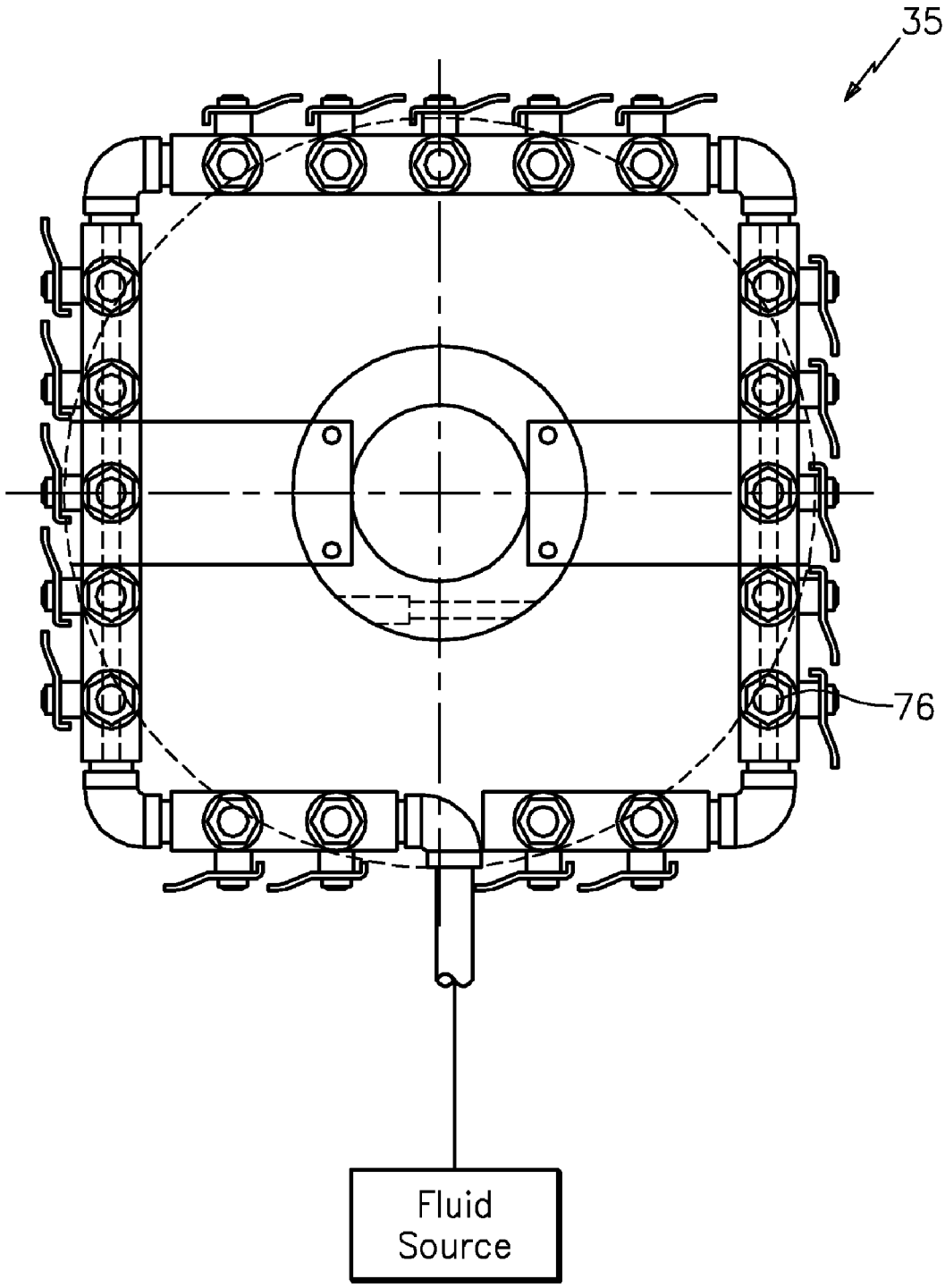
FIG. 3A is a schematic view of a manifold for a multiple of fixtures ganged together as in FIG. 3B.
Figure 3B:
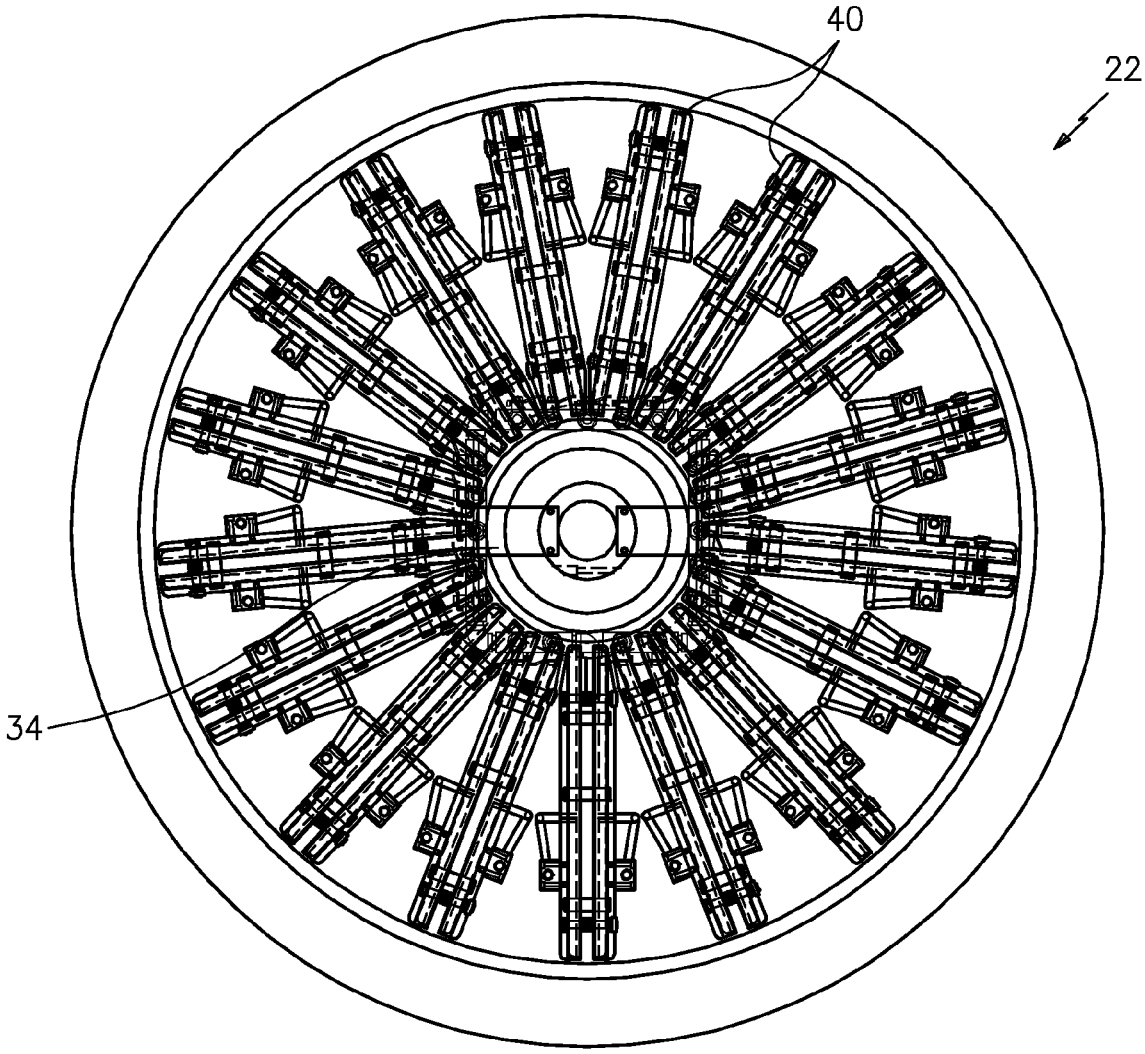
FIG. 3B is a front view of a multiple of fixtures ganged together according to an exemplary aspect of the present disclosure.

The fixture 40 generally includes a housing assembly 42 a bladder assembly 44 and a pressure bar assembly 46. Although a single fixture 40 will be described in detail, it should be understood that a multiple of fixtures 40 may be ganged together through a manifold 35 (FIG. 3A) to facilitate simultaneous bonding of a multiple of FISF 30 to every strut 28 (FIG. 3B). Each fixture 40 in the disclosed, non-limiting embodiment, is operable to apply a bonding pressure of 100 psi to the FISF trailing edge 30T and maintain the pressure during an entire thermal bond cycle at a maximum temperature of 300 F over a time period which may be from one to three hours. The fixture 40 also readily accommodates the restricted geometry of the Fan Inlet Case (FIG. 3B).

The housing assembly 42 generally includes a first housing 42A and a second housing 42B defined along an axis A. A multiple of pins 50 (FIG. 2B) and a multiple of fasteners 52 (FIG. 2C) transverse to the axis A support the first housing 42A and the second housing 42B. The multiple of pins 50 permit movement of the first housing 42A and the second housing 42B relative the axis A while the multiple of fasteners 52 set a maximum distance between the first housing 42A and the second housing 42B relative the axis A.

Figure 2B:
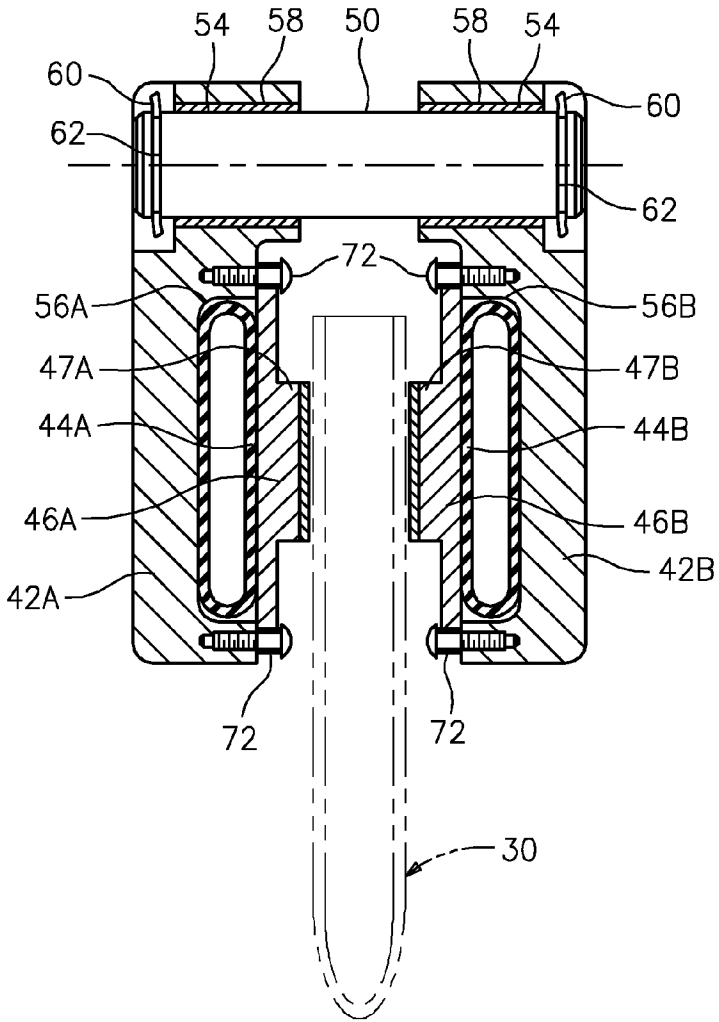
FIG. 2B is a sectional view of the fixture taken along line 2B-2B in FIG. 2A.

Referring to FIG. 2B, each of the multiple of the pins 50 are located through a respective aperture 54 in the respective first housing and second housing 42A, 42B adjacent a slot 56A which supports the bladder 44A. A bushing 58 may be located within each aperture 54 to support the respective pin 50 and facilitate replacement thereof. Each pin 50 may be retained by clips 60 or other retainers which are received within a respective groove 62 within an end section of the pin 50.

Figure 2C:
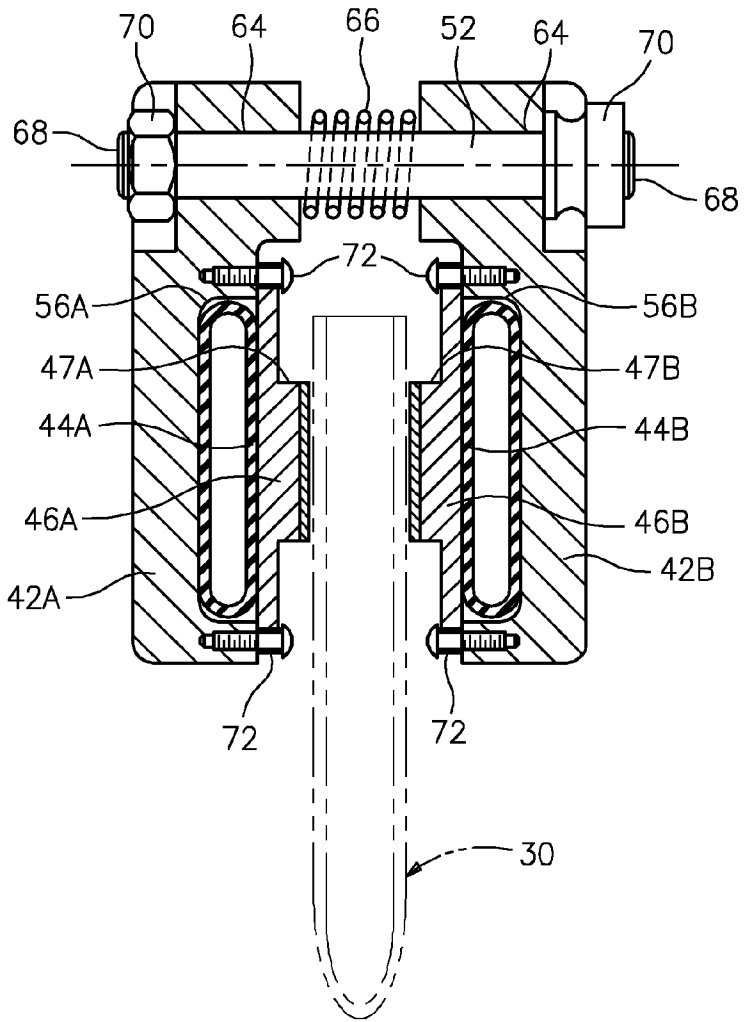
FIG. 2C is a sectional view of the fixture taken along line 2C-2C in FIG. 2A.

Referring to FIG. 2C, each of the multiple of the fasteners 52 are located through a respective apertures 64 in the respective first housing and second housing 42A, 42B adjacent a slot 56B which supports the bladder 44B. A biasing member 66 such as a spring may be located about the fastener 52 between the first housing and second housing 42A, 42B to bias the first housing and second housing 42A, 42B generally outward relative the axis A. Each fastener 52 may include a threaded section 68 to receive a retainer 70 such as a nut or other attachment.

A pressure bar 46A, 46B of the pressure bar assembly 46 is located over the respective slot 56A, 56B. Each pressure bar 46A, 46B mechanically entraps each bladder 44A, 44B within the respective slot 56A, 56B to support high pressure bladder reliability and minimize the travel requirements of the bladders 44A, 44B. Each pressure bar 46A, 46B may be of a generally T-shape to concentrate force therefrom with a reduced section 47A, 47B opposite the respective slot 56A, 56B so as to concentrate pressure upon a workpiece such as the trailing edge 30T. Each reduced section 47A, 47B surface may be covered with a non-metallic material such as silicone to prevent workpiece damage and slippage. It should be understood that each pressure bar 46A, 46B may include an alternative shape, such as an arcuate face for the reduced section 47A, 47B to facilitate a desired interface and concentration upon a workpiece.

Each pressure bar 46A, 46B is movably mounted over the respective slot 56A, 56B with a multiple of retainers 72 arranged in a row along an upper and lower length of the respective pressure bar 46A, 46B to permit movement of the pressure bar 46A, 46B relative the respective slot 56A, 56B in response to pressurization of the associated bladder 44A, 44B.

Figure 2D:
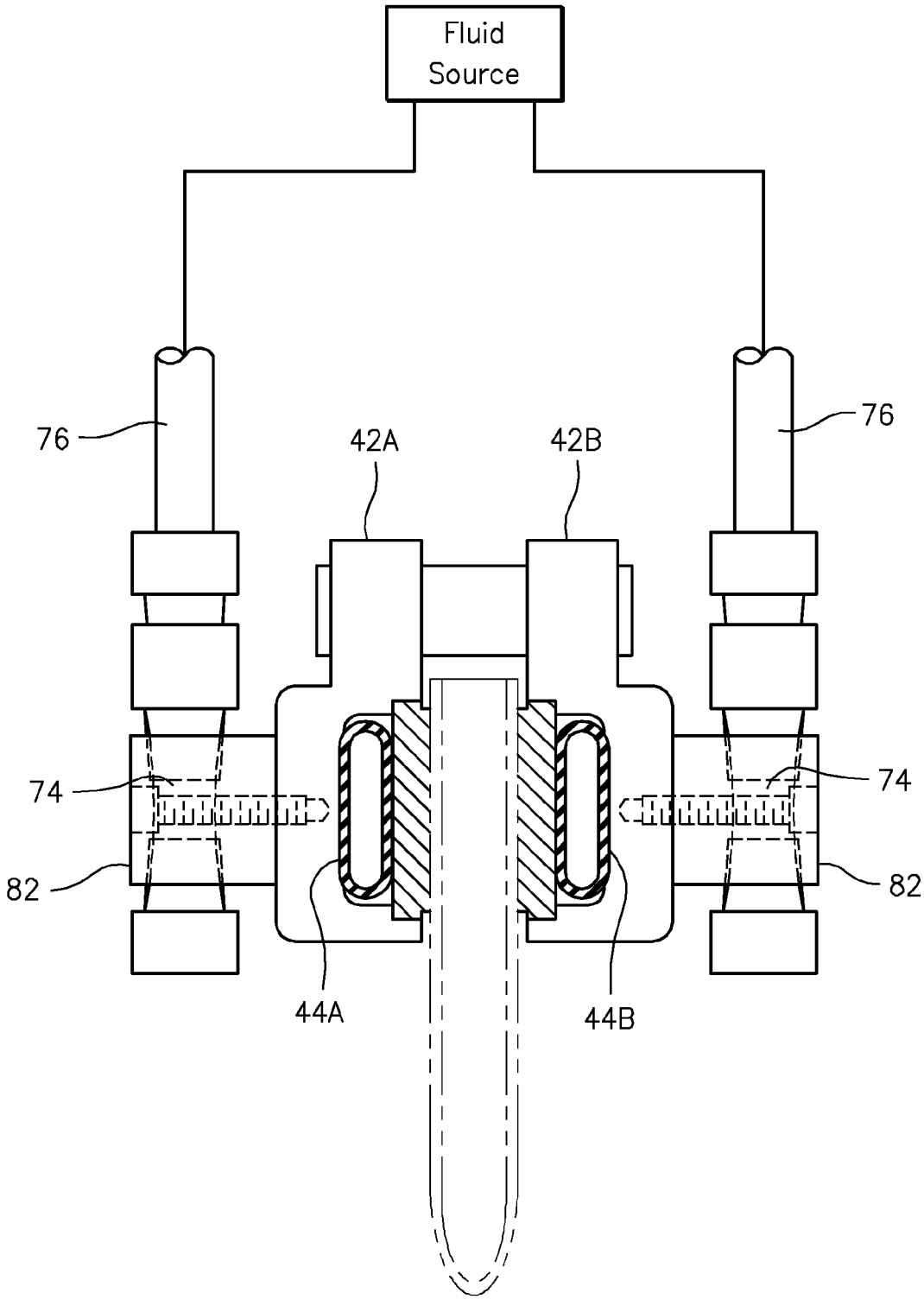
FIG. 2D is a sectional view of the fixture taken along line 2D-2D in FIG. 2A.
Figure 2E:
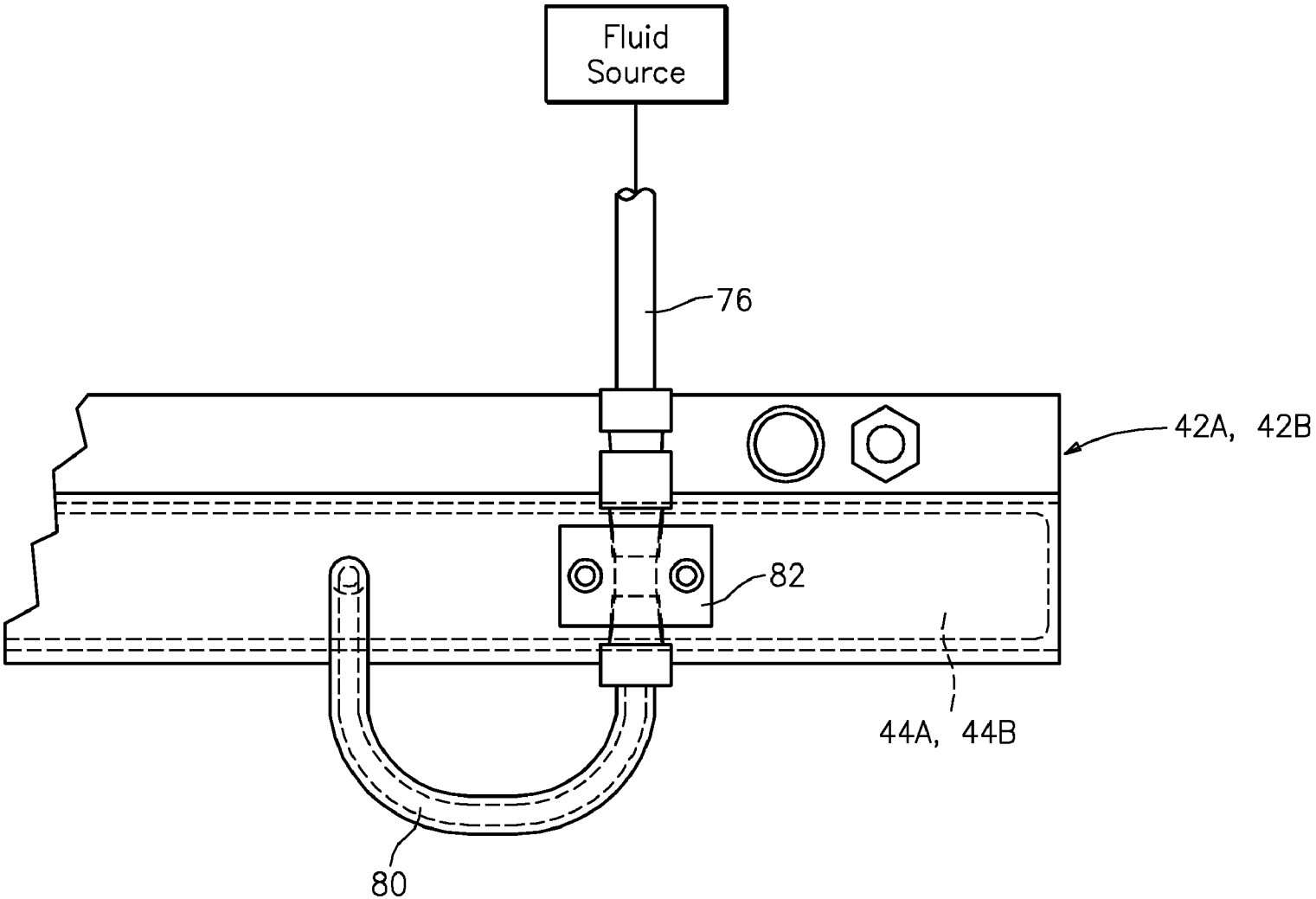
FIG. 2E is a side view of the fixture.

Referring to FIG. 2D, the respective bladder 44A, 44B is pressurized through a low flow orifice 74. A fluid conduit 76 from a fluid source 78 such as an air compressor or hydraulic accumulator communicates the pressurized fluid through the low flow orifice 74 and into a tube 80 which extends from the respective bladder 44A, 44B (FIG. 2E). The tube 80 may be an integral portion of each bladder 44A, 44B.

The low flow orifice 74 ensures the fluid flow from a failed bladder is insufficient to disrupt the accurate pressure application of the remaining bladder. The low flow orifice 74 provides a relatively low flow rate. The low flow orifice 74 may be mounted within a support 82 on each of the respective first housing and second housing 42A, 42B. The support 82 provides for an interface between the fluid conduit 76 and the tube 80 (FIG. 2E) which is compact to allow usage within the relatively tight constraints of the typical aerospace component (FIG. 3A).

In operation, the housing assembly 42 is placed around the work piece such that the pressure bar assembly 46 is positioned at the desired location. The retainer 70 is then tightened to bring the pressure bar 46A, 46B in contact with the workpiece. Notably, the retainer 70 need typically be only hand-tightened to provide the desired contact. The biasing member 66 operates to hold apart the first housing and second housing 48A, 48B until the retainer 70 is tightened to facilitate attachment to the workpiece. Fixture 40 adjustment on the workpiece is readily achieved without go/no-go gauge adjustments during setup which minimizes labor and pressure uncertainties.

Fluid pressure from the pressure source 78 is communicated to pressurize each bladder 44A, 44B. Typical shop air pressures for operation is sufficient with the pressure bar 46A, 46B concentrations. The low flow orifice 74 may require a relatively significant period of time to pressurize each bladder 44A, 44B—on the order of minutes—but when placed in context of the period of time under which the bladders 44A, 44B are under pressure—on the order of hours—the assurance of redundancy provided by the low flow orifice 74 is significant. That is, if one bladder 44A, 44B fails the other bladder 44B, 44A will continue to apply pressure which significantly reduces the risk of workpiece loss during the curing processing.

A failed bladder condition results in the associated pressure bar 46A, 46B movement into contact with the respective first housing or second housing 42A, 42B. The travel provided by the associated pressure bar 46A, 46B is small enough to be compensated by the travel of the opposing pressure bar 46A, 46B. That is, the fixture 40 allows the first housing and second housing 42A, 42B to be positioned such that the pressure is maintained on the workpiece by but one operational bladder 44A, 44B and contact between the pressure bar 46A or 46B and housing 42A or 42B associated with the failed bladder.

Pressurization of the bladders 44A, 44B operates to apply force on the respective pressure bar 46A, 46B and thus onto the workpiece. The range of force applied by the pressure bars 46A, 46B is readily adjustable through a change in the ratio of the pressure bars 46A, 46B contact area to the respective bladder 44A, 44B area. This facilities bladder 44A, 44B operation below the maximum pressure of the fluid supply which allows for accurate application of pressure and high reliability of the bladders 44A, 44B. The bladders 44A, 44B also apply a higher part pressure than the maximum pressure of the fluid supply through the concentration applied by the pressure bars 46A, 46B. The pressure bars 46A, 46B may be readily changed to provide for different pressure profiles with the same bladders 44A, 44B and fluid source 78. The fixture 40 eliminates the mechanical friction, seizure and pressure limitations of mechanical clamp designs.

Pressurization of the bladders 44A, 44B and the resultant force application to the workpiece is reacted by the pins 50 which may be of a relatively significant diameter. The pins 50 provides a rigid support which prevents undesirable deflection of the first housing 42A relative to the second housing 42B when the bladder assembly 44 is pressurized. That is, the fasteners 52 essentially set the distance between the first housing and second housing 42A, 42B while the pins 50 resist the deflection loads between the first housing and second housing 42A, 42B when the bladder assembly 44 is pressurized.

Once the curing cycle is completed, the bladder assembly 44 is depressurized, the fasteners 52 loosened to provide clearance for the removal of fixture 40 from the workpiece. The biasing member 66 facilitates separation the first housing 42A from the second housing 42B and thus removal of the fixture 40 from the workpiece.

It should be understood that relative positional terms such as "forward," "aft," "upper," "lower," "above," "below," and the like are with reference to the normal operational attitude of the vehicle and should not be considered otherwise limiting.

It should be understood that like reference numerals identify corresponding or similar elements throughout the several drawings. It should also be understood that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed is:

1. A fixture for an electro thermal fan inlet case of a gas turbine engine comprising:

a housing assembly which defines a first slot along an axis, the housing assembly operable to receive a fairing and a respective strut of the electro thermal fan inlet case;

a pressure bar assembly mounted to said housing assembly adjacent to said first slot for movement relative to said axis; and a bladder assembly mounted at least partially within said first slot, pressurization of said bladder assembly operable to exert a force on said fairing to clamp said fairing to said strut with said pressure bar assembly.

2. The fixture as recited in claim 1, wherein said bladder assembly is pressurized through a low flow orifice.

3. The fixture as recited in claim 2, wherein said low flow orifice assures pressure of at least one bladder of said bladder assembly while another bladder of said bladder assembly has failed in response to a pressure provided by a pressure source.

4. The fixture as recited in claim 3, wherein pressure source provides less than 100 psi or pressure.

5. The fixture as recited in claim 1, wherein said first bladder and said second bladder are pressurized through a respective low flow orifice.

6. The fixture as recited in claim 1, further comprising a multiple of pins which supports said first housing relative said second housing.

7. The fixture as recited in claim 1, further comprising at least one fastener which sets a distance of said first housing relative said second housing.

8. The fixture as recited in claim 7, further comprising a resilient member mounted about said at least one fastener, said resilient member located between said first housing relative said second housing to bias said first housing and said second housing away from said axis.

9. The fixture as recited in claim 1, wherein said first and second pressure bar each define a concentration surface.

10. The fixture as recited in claim 1, wherein said first and second pressure bar each are of a T-shape in lateral cross-section.

11. The fixture as recited in claim 1, wherein said fairing is a fan inlet shroud fairing (FISF).

12. The fixture as recited in claim 11, wherein said (FISF) is bonded to each strut generally along a FISF trailing edge.

13. A fixture comprising:

a first housing which defines a first slot;

a first bladder at least partially within said first slot;

a first pressure bar movably mounted relative said first slot, said first pressure bar movable relative said axis in response to pressurization of said first bladder;

a second housing which defines a second slot generally opposite said first slot along an axis;

a second housing which defines a second slot generally opposite said first slot along an axis;

a second bladder at least partially within said second slot; and a second pressure bar movably mounted relative said second slot, said second pressure bar movable relative said axis in response to pressurization of said second bladder.

14. A method of simultaneously bonding a multiple of fairings to a respective multiple of struts in a gas turbine engine case comprising:

mounting a fixture assembly to each of the multiple of fairings which extend at least partially around a respective strut; and pressurizing a bladder assembly within each of the fixture assemblies to exert a force on the respective fairing.

15. A method as recited in claim 14, further comprising:

exerting the force through a pressure bar assembly adjacent the bladder assembly.

16. A method as recited in claim 15, wherein pressurizing the bladder assembly further comprising:

maintaining the pressure within the bladder assembly with a pressure source.

17. A method as recited in claim 14, wherein pressurizing the bladder assembly further comprising:

pressurizing the bladder assembly through a low flow orifice.

* * * * *